US005114048A

United States Patent [19]

Minke

[11] Patent Number: 5,114,048

[45] Date of Patent: May 19, 1992

[54] FAUCET ASSEMBLY HAVING INTEGRAL LIQUID PRODUCT DISPENSER

[76] Inventor: Robert M. Minke, 4043 Rose Garden, Toledo, Ohio 43623

[21] Appl. No.: 628,103

[22] Filed: Dec. 17, 1990

[51] Int. Cl.[5] ..... B67D 5/52

[52] U.S. Cl. ..... 222/135; 222/192; 222/331

[58] Field of Search ..... 239/304; 222/135, 179, 222/180, 330, 331, 372, 192

[56] References Cited

U.S. PATENT DOCUMENTS

| | | | |
|---|---|---|---|
| 92,110 | 6/1969 | Shortt | 222/181 |
| 517,624 | 4/1994 | Potter | 141/60 |
| 923,447 | 6/1909 | Schmidt | 222/180 |
| 2,333,763 | 8/1940 | Bobrick | 222/372 |
| 2,785,012 | 3/1957 | Frewin | 222/185 |
| 3,079,093 | 2/1963 | Bellows | 222/145 |
| 3,190,502 | 6/1965 | Knibb | 222/180 |
| 3,198,437 | 8/1965 | Faglie | 222/180 |
| 3,208,145 | 9/1965 | Turner | 239/549 |
| 3,409,230 | 11/1968 | Eelkema | 222/145 |
| 3,623,638 | 11/1971 | Henning | 222/181 |
| 3,713,585 | 1/1973 | Conklin | 222/383 |
| 3,720,352 | 3/1973 | Kozlewski | 239/305 |
| 3,920,160 | 11/1975 | Casale et al. | 222/180 |
| 3,990,611 | 11/1976 | Sojka | 222/180 |
| 4,625,896 | 12/1986 | Rocchelli | 222/180 |

FOREIGN PATENT DOCUMENTS

| | | | |
|---|---|---|---|
| 8100251 | 2/1981 | World Int. Prop. O. | 222/179 |

*Primary Examiner*—Michael S. Huppert
*Assistant Examiner*—Kenneth Bomberg
*Attorney, Agent, or Firm*—MacMillan, Sobanski & Todd

[57] ABSTRACT

A faucet assembly having an integral dispenser for supplying liquid products, such as soap, lotion, and the like, adjacent to the flow of water therefrom is disclosed. The faucet assembly includes a housing having a conventional mixer tap mounted therein for supplying water from a spigot. A pair of upstanding liquid dispenser housings are formed integrally with or secured to the faucet assembly housing. Within each of these dispenser housing, a manually operable pump assembly is disposed. The pump assemblies are manually operable to pump liquid products from respective liquid reservoirs to a dispenser block located within the faucet assembly adjacent to the spigot thereof. The dispenser block discharges the liquid products adjacent to the flow of water from the faucet assembly. The dispenser block may be formed integrally with the faucet housing or as a separate piece releasably secured thereto.

10 Claims, 2 Drawing Sheets

FAUCET ASSEMBLY HAVING INTEGRAL LIQUID PRODUCT DISPENSER

BACKGROUND OF THE INVENTION

This invention relates in general to faucets and in particular to a faucet assembly having an integral dispenser for supplying liquid products, such as soap, lotion, and the like, adjacent to the flow of water from the spigot of the faucet assembly.

Faucet assemblies are well known structures for delivering hot and cold water into a water basin, such as a sink. Such faucet assemblies typically include a mixer tap or similar valve assembly having inlets which are connected to the hot and cold water supply lines. The mixer tap further includes an outlet which is connected to a spigot disposed over the water basin. A manually operable handle is provided on the mixer tap to permit a user to control both the amount of water which is discharged from the spigot and the temperature thereof.

Frequently, faucet assemblies of this type are used to supply water for cleaning purposes. In these instances, soap or similar products are used for cleaning, while water from the faucet assembly is used for rinsing. In most homes, the soap is provided in bar form or in a liquid soft soap dispenser. In many business and commercial locations, liquid soap is provided in a pump-actuated dispenser which is separate from the faucet assembly itself. In any event, it is often convenient to provide some form of soap or other liquid product in the vicinity of the faucet assembly.

Unfortunately, dispensers of liquid soap and similar liquid products are often inconvenient to use because they are separate from the faucet assemblies with which they are used, usually in a remote location. Thus, the soap or other liquid product which is discharged from the dispenser is not located adjacent to the flow of water from the spigot of the faucet assembly. Consequently, a user of the liquid dispenser must reach inconveniently to the side of the water basin. Furthermore, excess soap or other liquid products which drip from the dispenser usually fall into the water basin and remain in the bottom thereof, unless an affirmative effort is made by the user to clean it. Thus, it would be desirable to provide a faucet assembly having an integral dispenser for supplying liquid products, such as soap, lotion, and the like, adjacent to the flow of water from the spigot of a faucet assembly.

SUMMARY OF THE INVENTION

This invention relates to a faucet assembly having an integral dispenser for supplying liquid products, such as soap, lotion, and the like, adjacent to the flow of water therefrom. The faucet assembly includes a housing having a conventional mixer tap mounted therein for supplying water from a spigot. One or more of upstanding liquid dispenser housings are formed integrally with or secured to the faucet assembly housing. Within each of these dispenser housing, a manually operable pump assembly is disposed. The pump assemblies are manually operable to pump liquid products from respective liquid reservoirs to a dispenser block located within the faucet assembly adjacent to the spigot thereof. The dispenser block discharges the liquid products adjacent to the flow of water from the faucet assembly. The dispenser block may be formed integrally with the faucet housing or as a separate piece releasably secured thereto.

It is an object of this invention to provide a faucet assembly having an integral dispenser for supplying liquid products, such as soap, lotion, and the like, adjacent to the flow of water therefrom.

It is another object of this invention to provide such a faucet assembly which is simple and inexpensive in construction and operation.

Other objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
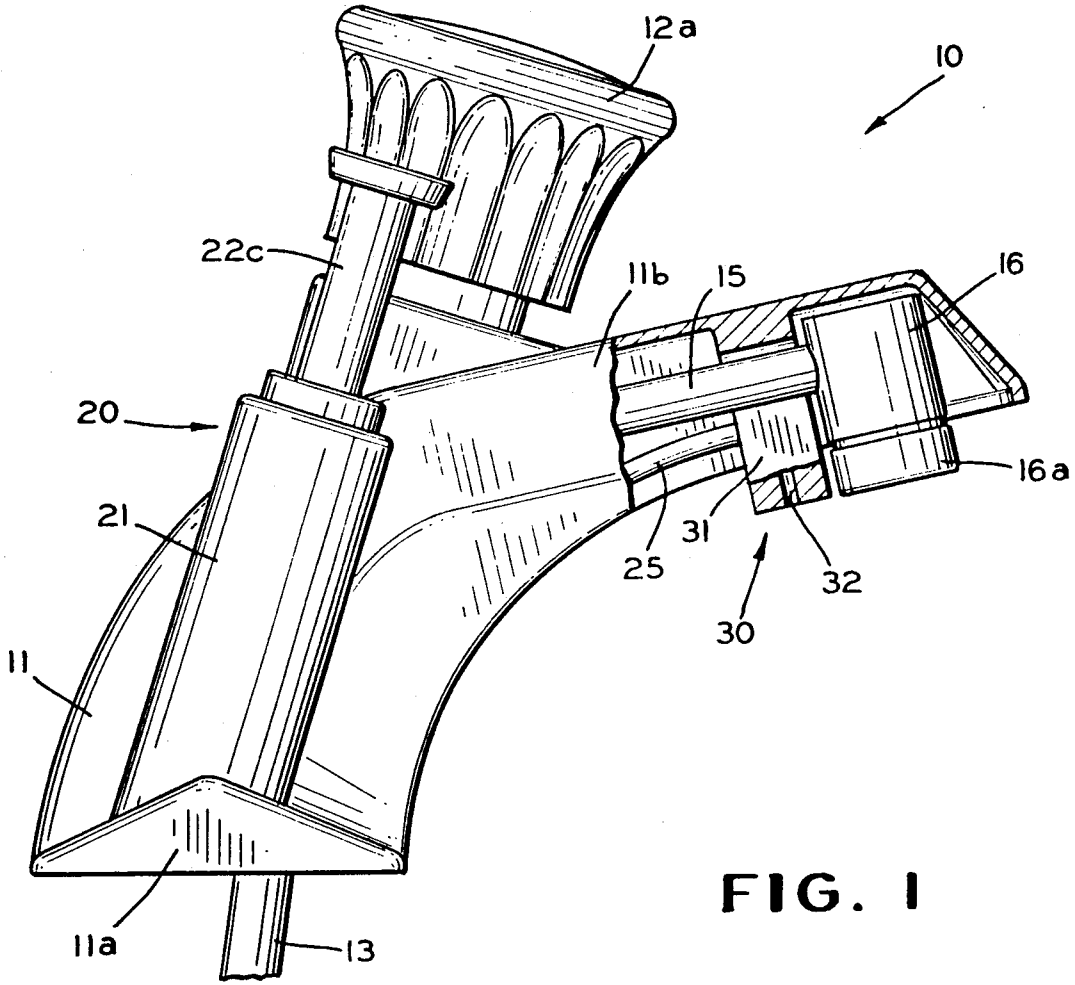
FIG. 1 is a side elevational view, partially broken away, of a faucet assembly having an integral dispenser for supplying liquid products in accordance with this invention.
Figure 2:
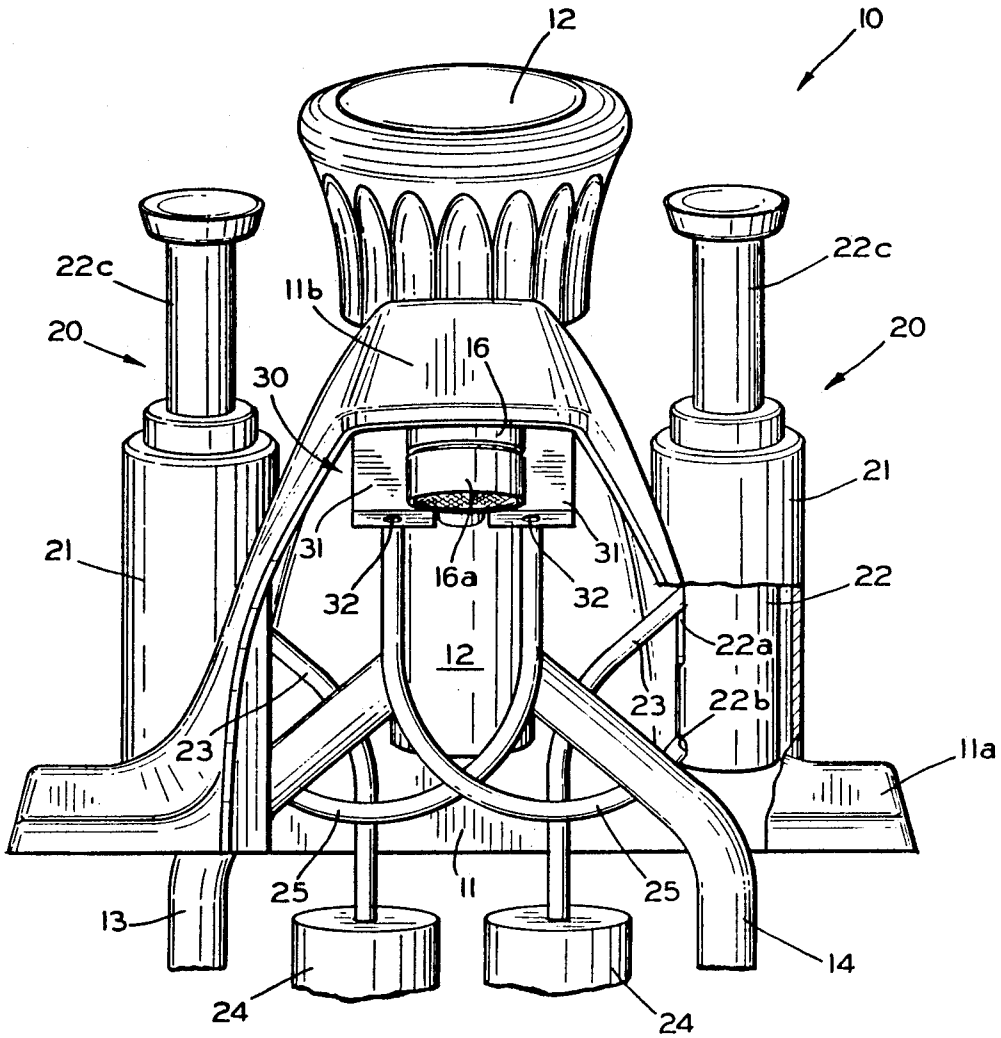
FIG. 2 is a front elevational view, partially broken away, of the faucet assembly illustrated in FIG. 1.

Referring now to the drawings, there is illustrated in FIGS. 1 and 2 a faucet assembly, indicated generally at 10, in accordance with this invention. The faucet assembly 10 includes a housing 11 having a base portion **11*a* and an arm portion 11*b*. The base portion 11*a* is adapted to be secured to a flat surface adjacent to a water basin, such as the edge of a sink (not shown), so as to support the faucet assembly 10 thereon. The arm portion 11*b* is angled upwardly and outwardly relative to the base portion 11*a*** so as to extend over the water basin.

As best shown in FIG. 2, the lower surface of the arm portion **11*b* is open. This construction facilitates the manufacture of the housing, as well as to permitting the components of the faucet assembly 10 described below to be mounted therein. Typically, a cover plate (not shown) is secured to lower surface of the arm portion 11*b*. The cover plate covers the other components of the faucet assembly 10 and enhances the overall aesthetic appearance of the faucet assembly 10**.

A mixer tap 12 or similar valve assembly is mounted within the arm portion **11*b* of the faucet assembly 10. The mixer tap 12 is well known in the art and includes a pair of inlets which are connected to respective hot and cold water supply lines 13 and 14. The mixer tap 12 further includes an outlet which is connected to an outlet line 15. The outlet line 15 is connected to a spigot 16, which typically includes a conventional aerator 16*a*. The mixer tap 12 contains an internal valve assembly (not shown) which regulates the amount of water which passes therethrough, as well as the relative mixture of hot and cold water from the supply lines 13 and 14**.

An upstanding handle **12*a* is provided on the mixer tap 12 for permitting a user to easily control the operation of this internal valve assembly. By manipulating the handle 12*a* in a known manner, a user can control the amount of water which is discharged from the spigot 16 into the water basin, as well as the temperature thereof. Thus, water from the supply lines 13 and 14 is mixed and controlled as desired in the mixer tap 12 and discharged from the spigot 16 and the aerator 16***a* into the water basin.

The faucet assembly 10 is further provided with first and second liquid dispensers, indicated generally at 20. In the illustrated embodiment, the liquid dispensers 20 are conveniently located on opposite sides of the handle 12*a*. Each dispenser 20 includes an upstanding cylindrical dispenser housing 21 which is formed integrally with the faucet housing 11. Alternatively, the dispenser housings 21 may be formed as separate pieces secured within respective apertures formed in the base portions 11*a* of the faucet housing 11.

Within each of the dispenser housings 21, a hand operated liquid pump assembly 22 is disposed Each pump assembly 22 is conventional in the art, including an inlet 22*a*, an outlet 22*b*, and an actuator rod 22*c*. The pump assembly inlets 22*a* are connected through flexible supply lines 23 to respective liquid reservoirs 24. The liquid reservoirs 24 are filled with liquid products which are desired for use with the faucet assembly 10. For example, one reservoir 24 may be filled with a liquid soap product, while the other reservoir 2 may be filled with a skin conditioning lotion. The pump assembly outlets 22*b* are connected through respective flexible conduits 25 to a dispenser block, indicated generally at 30. The structure of the dispenser block 30 will be described in detail below. The actuator rods 22*c* extend upwardly from the associated dispenser housings 21.

The actuator rods 22*c* are adapted to be manually pushed downwardly by a user from the positions illustrated in the drawings toward the base portion 11*a* of the faucet housing 11. When this occurs, liquid is pumped from the corresponding liquid reservoirs 24, through the flexible supply lines 23 to the inlets 22*a* of the pump assemblies 22, and from the outlets 22*b* thereof through the flexible conduits 25 to the dispenser block 30. When the actuator rod 22*c* is released, an internal spring (not shown) returns the actuator rod 22*c* upwardly to its original position illustrated in the drawings. This reciprocating movement of the actuator rod 22*c* can be repeated as necessary to pump a desired amount of the liquid from the reservoirs 24 to the dispenser block 30.

As shown in FIGS. 1 and 2, the dispenser block 30 is formed integrally with the arm portion 11*b* of the faucet housing 11. The dispenser block 30 includes two depending portions 31 which form a generally inverted-U shape. The depending portions 31 of the dispenser block 30 are disposed on opposite sides of the outlet line 15 extending from the mixer tap 12 to the spigot 16. Each of the depending portions 31 has a passageway 32 formed therethrough. The upper ends of the passageways 32 communicate with the conduits 25 from the pump assemblies 22. The lower ends of the passageways 32 terminate adjacent to the aerator 16*a* of the spigot 16.

It will thus be appreciated that when the actuator rods 22*c* are pushed downwardly as described above, liquid will be pumped through the dispenser block 30 and out of the lower ends of the passageways 32. Because such lower ends are disposed adjacent to the aerator 16*a*, the liquid products dispensed therefrom will flow adjacent to the flow of water from the spigot 16 of the faucet assembly 10. Accordingly, such liquid will be conveniently dispensed for the user.

Figure 3:
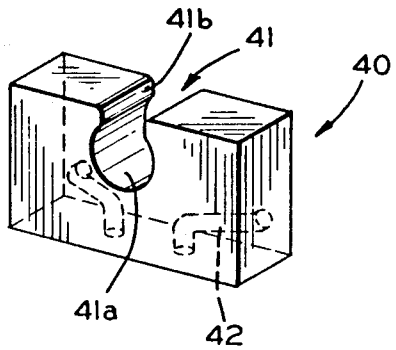
FIG. 3 is a perspective view of an alternate embodiment of the dispenser block illustrated in FIGS. 1 and 2.

Referring now to FIG. 3, the structure of an alternate embodiment of the dispenser block 40 is illustrated. As shown therein, the dispenser block 40 is embodied as a small block of corrosion resistant material, preferably a relatively hard plastic material such as nylon. A recess, indicated generally at 41, is formed in the upper end of the dispenser block 40. Passageways 42 are formed through the dispenser block 40 for the same purpose as the passageways 32 discussed above. The recess 41 includes a generally cylindrical portion 41*a* defining a predetermined diameter and a neck portion 41*b* extending from the cylindrical portion 41*a* to the upper end of the dispenser block 40. The neck portion 41*b* defines a gap which is slightly less in width than the diameter defined by the cylindrical portion 41*a*. Preferably, the diameter of the cylindrical portion 41*a* is approximately equal to the outer diameter of the outlet line 15 extending from the outlet of the mixer tap 12 to the spigot 16.

The dispenser block 40 is releasably secured to the outlet line 15. To accomplish this, the neck portion 41*b* of the recess 41 is disposed adjacent to the outlet line 15. Then, an upwardly directed force is exerted against the dispenser block 40. When a sufficient force is exerted, the plastic material of the dispenser block 40 will deform slightly, allowing the outlet line 15 to snap through the neck portion 41*b* into the cylindrical portion 41*a*. Because of the reduced width of the neck portion 41*b*, the dispenser block 40 will be retained on the outlet line 15 for use. If it ever becomes necessary or desirable to remove the dispenser block 40, it can be pried off of the outlet line 15 by exerting a sufficient force in the downward direction. The structure and operation of the dispenser block 40 is otherwise identical to the dispenser block 30 described above.

In accordance with the provisions of the patent statutes, the principle and mode of operation of this invention have been described and illustrated in its preferred embodiment. However, it must be understood that this invention may be practiced otherwise than as specifically explained and illustrated without departing from its spirit or scope.

What is claimed is:

1. A faucet assembly adapted to dispense water and a liquid product adjacent one another comprising:

a faucet housing including a base portion adapted to be mounted adjacent a water basin and an arm portion extending from said base portion and adapted to extend over the water basin;

a dispenser housing extending within said faucet housing and mounted on said base portion;

a pump disposed in said dispenser housing, said pump having an inlet port adapted to communicate with a supply of the liquid product and an outlet port;

a spigot mounted on said arm portion and adapted to dispense water therefrom;

means disposed within said arm portion of said faucet housing for dispensing the liquid product adjacent said spigot; and conduit means for providing fluid communication between said outlet port of said pump and said liquid product dispensing means.

2. The invention defined in claim 1 wherein said means for dispensing includes a dispenser block disposed within said arm portion of said faucet housing for dispensing the liquid product adjacent said spigot.

3. The invention defined in claim 2 wherein said dispenser block is formed integrally with said arm portion of said faucet housing.

4. The invention defined in claim 2 wherein said faucet assembly includes a line for supplying water to said spigot, and wherein dispenser block is retained on said water supply line.

5. The invention defined in claim 4 wherein said dispenser block is formed having a recess including a neck portion extending to an inner portion, said neck portion defining a width which is slightly smaller than the width of said water supply line and said inner portion defining a width which is approximately equal to the width of said water supply line.

6. A faucet assembly adapted to dispense water and a pair of liquid products adjacent one another comprising:

a faucet housing including a base portion adapted to be mounted adjacent a water basin and an arm portion extending from said base portion and adapted to extend over the water basin;

first and second dispenser housings extending within said faucet housing and mounted on said base portion on opposite sides of said arm portion;

first and second pumps respectively disposed in said first and second dispenser housings, each of said pumps having an inlet port adapted to communicate with a supply of the liquid product and an outlet port;

a spigot mounted on said arm portion and adapted to dispense water therefrom;

means disposed within said arm portion of said faucet housing for dispensing the liquid product adjacent said spigot; and conduit means for providing fluid communication between each of said outlet ports of said first and second pumps and said liquid product dispensing means.

7. The invention defined in claim 6 wherein said means for dispensing includes a dispenser block disposed within said arm portion of said faucet housing for dispensing the liquid products adjacent said spigot.

8. The invention defined in claim 7 wherein said dispenser block is formed integrally with said arm portion of said faucet housing.

9. The invention defined in claim 7 wherein said faucet assembly includes a line for supplying water to said spigot, and wherein dispenser block is retained on said water supply line.

10. The invention defined in claim 9 wherein said dispenser block is formed having a recess including a neck portion extending to an inner portion, said neck portion defining a width which is slightly smaller than the width of said water supply line and said inner portion defining a width which is approximately equal to the width of said water supply line.

* * * * *